United States Patent [19]

Jelsma

[11] Patent Number: 4,938,299

[45] Date of Patent: Jul. 3, 1990

[54] FLEXIBLE CENTRALIZER

[75] Inventor: Henk H. Jelsma, Spring, Tex.

[73] Assignee: Baroid Technology, Inc., Houston, Tex.

[21] Appl. No.: 386,415

[22] Filed: Jul. 27, 1989

[51] Int. Cl.[5] ..... E21B 7/08; E21B 17/10; E21B 17/20

[52] U.S. Cl. ..... 175/73; 175/76; 175/325

[58] Field of Search ..... 175/325, 73, 74, 75, 175/76, 320; 166/241

[56] References Cited

U.S. PATENT DOCUMENTS

| | | | |
|---|---|---|---|
| 2,072,320 | 3/1937 | Thomas | 175/325 |
| 2,743,082 | 4/1956 | Zublin | 175/75 X |
| 2,819,040 | 1/1958 | James et al. | 175/325 |
| 2,829,864 | 4/1958 | Knapp | 175/325 |
| 3,068,946 | 12/1962 | Frisby et al. | 175/73 |
| 3,104,134 | 9/1963 | Nielsen et al. | 175/325 |
| 3,320,004 | 5/1967 | Garrett | 175/325 |
| 4,343,369 | 8/1982 | Lyons et al. | 175/75 |
| 4,456,080 | 6/1984 | Holbert | 175/61 |
| 4,685,895 | 8/1987 | Hatten | 175/325 |

FOREIGN PATENT DOCUMENTS

| | | | |
|---|---|---|---|
| 407026 | 4/1974 | U.S.S.R. | 175/74 |

*Primary Examiner*—Hoang C. Dang

*Attorney, Agent, or Firm*—Browning, Bushman, Anderson & Brookhart

[57] ABSTRACT

A downhole centralizer is provided for positioning along a drill pipe string passing through a deviated well bore. A centralizer body is connected to an upper sub by a plurality of lobe-shaped connectors which permit angular deviation of the central axis of the upper sub with respect to the central axis of the centralizer body. The centralizer body is preferably connected to a lower sub by similar lobe-shaped connectors. The opposite ends of each of the upper and lower subs are threaded for fixed engagement with respective upper and lower pipe joints in the tubular string. A flexible flow conduit is positioned within a passageway through the centralizer body, and a pair of upper and lower sealing member are provided to maintain sealed engagement between the respective upper and lower subs and the flow conduit for transmission of fluid through the centralizer. The centralizer of the present invention may be reliably used to center the tubing string within the deviated portion of a borehole, thereby reducing torque lossed to the drill bit and wear on the drill string.

16 Claims, 1 Drawing Sheet

FLEXIBLE CENTRALIZER

BACKGROUND OF THE INVENTION

1. Field of the Invention

The present invention relates to downhole centralizers used in oilfield operations and, more particularly, relates to an improved centralizer for positioning on a drill string for use in a borehole with high angle build rates, such that the centralizer maintains the drill string centered within the build portion of a borehole yet allows high torque to be transmitted to the drill bit and produces a centralized means of stabilization and directional control.

2. Description of the Background

Both centralizers and stabilizers generally include a sleeve-shaped metal body for positioning downhole along a tubular string and an outer material sleeve for engaging sidewalls of the borehole. Centralizers have been used for decades in oilfield drilling operations to keep the tubular centered within a borehole or within a larger diameter tubular. Stabilizers are similar to centralizers, but are primarily used to maintain a desired path for the borehole or hold a drill bit on a desired course. As used herein, the term "centralizer" is intended to include both centralizers and stabilizers as those terms are commonly used in oilfield operations.

When drilling angle building wells, lengths of drill pipe have been interconnected with lobed mechanisms which allow angular movement of a lower joint of pipe with respect to an upper joint of pipe, thereby facilitating the bending of the drill string through the arcuate path of the build up. While drill strings comprising lengths of drill pipe interconnected by lobe-shaped mechanisms can be successfully used to transmit torque from the surface to a bit in a well with a high build-up rate, they do not result in the drill string being centered within the deviated portion of the borehole. Accordingly, high torque losses are encountered when the drill string rubs against the sidewalls of the borehole during the drilling operation, thereby causing excessive wear of the drill pipe.

Special problems are encountered using centralizers in wells with relatively sharp borehole deviations. Sharp or highly deviated boreholes are increasingly used, however, to recover hydrocarbons from subterranean formations at lower overall costs, or to recover more hydrocarbons in less time than conventional vertical boreholes. A centralizer ideally should keep the drill string centered with respect to the borehole through the curve of the deviation and/or maintain the drill bit on its desired course, but does not substantially increase the risk that the centralizer will become "stuck" in the borehole. Also, a centralizer should be able to transmit high torque loads and axially directed forces through the drill string to the bit, thereby enabling the drilling operation to be efficiently conducted. Also, a centralizer should be able to transmit high torque loads to the bit without substantial torque losses, so that less expensive torque generating equipment at the surface can be employed to obtain the desired torque on the bit, and so that the likelihood of failure of the drill string caused by high torque loads is minimized. Also, a centralizer preferably reduces the "walk" tendency of the drill bit due to reduced torque losses.

Drilling operators have heretofore often sacrificed the advantages of centralizers when drilling highly deviated boreholes, or have incurred increased cost to repeatedly trip in and out of the borehole to add or remove one or more centralizers from the drill string. In view of the increased use of deviated wells and wells which are vertically drilled to a desired depth and then highly angled for drilling horizontal or substantially horizontal boreholes, improved techniques are required so that operators can efficiently perform these drilling operations while obtaining the advantages of centralizers on the drill string.

The disadvantages of the prior art are overcome by the present invention, and an improved apparatus is hereinafter disclosed for use in a drill string which maintains the drill string centered within a deviated portion of a borehole and/or maintains the drill bit on its desired course while allowing high torque to be efficiently transmitted to the drill bit.

SUMMARY OF THE INVENTION

A centralizer according to the present invention includes centralizer blades which rotate about a polished centralizer body. The centralizer body may be attached to the drill pipe via subs located at the upper and lower ends of the body, or may be attached directly to the drill pipes. Each end of the centralizer body and the corresponding end of each upper and lower sub may be structurally connected by cooperating lobes which allow the sub to pivot with respect to the centralizer body while transmitting torque along the drill string to the bit. The central axis of each sub may be deflected in any direction within a plane perpendicular to the centralizer body axis through a relatively small and fixed angle of less than 4°, so that the drill string can more easily bend within a deviated portion of a borehole. The lobes interconnecting the centralizer body and the upper and lower subs are closely spaced to the respective upper and lower ends of the centralizer blades, and preferably are axially located within five times the diameter of a uniform outer diameter portion of the centralizer body from the respective upper and lower ends of the centralizer blades. Flexing of the drill string at the locations of the lobes thus allows the centralizer to more easily pass through a deviated portion of the well bore without becoming stuck, while proper positioning of the centralizer within the deviated portion of a well bore reduces torque losses caused by frictional engagement of the drill string with sidewalls of the borehole.

The upper and lower subs may be provided with internal threads for secured engagement with the threaded ends of drill pipe, and a cylindrical-shaped cavity between these threads and the interconnecting lobes for receiving a hose fitting. Pressurized fluid may thus be transmitted through the centralizer without leakage via a hose within the bore of the centralizer body which extends between the upper and the lower subs, with a respective hose fitting at each end of the hose sealingly engaging the side walls of the cylindrical cavity within the upper and lower subs. Each hose fitting may move axially in either direction within its respective sub to accommodate variations in tension and compression in the drill string and centralizer body.

In one embodiment of the present invention, a small diameter centralizer sleeve is provided closely adjacent the drill bit, with a comparatively larger diameter centralizer sleeve being axially positioned therebetween. An upper centralizer body which carries the small diameter centralizer sleeve is pivotally connected at its upper end to a drill pipe utilizing the upper sub and the lobed connections described above. A lower centralizer body is provided for carrying the larger diameter centralizer sleeve, and is pivotably connected to the upper centralizer body by similar lobed connections. The centralizer body for the larger diameter sleeve is then connected to a sub which directly or indirectly supports the drill bit. Accordingly, high flexing of the lower end of the drill string just above the bit is provided by the multiple lobed connections. Moreover, the desired drill path for the bit is more easily obtained by providing the larger diameter centralizer sleeve closely adjacent the drill bit, such that a slight upward tilt to the drill bit when positioned in a substantially horizontal borehole overcomes the tendency of the drill bit to drill downwardly.

It is an object of the present invention to provide an improved centralizer for use in a highly deviated borehole which can reliably transmit torque to the drill bit yet freely pass through the highly deviated portion of the borehole.

It is a further object of the invention that the centralizer keep the drill string centered within the deviated portion of the borehole without substantial risk of the centralizer becoming stuck in the well.

Still another object of the invention is a centralizer which efficiently transmits torque through a highly deviated portion of the borehole to reduce frictional wear on the drill string, and thus surface torque on the drill string.

It is a feature of the present invention that the upper and lower ends of the centralizer each be connected to drill pipe by a relatively simple yet reliable flex connection which allows the centralizer body to flex less than 4° with respect to the respective upper or lower drill pipe.

It is a further feature of the invention that a sub is provided between the centralizer body and the drill pipe for allowing flexing of the drill string, the sub being connected to the centralizer body by a plurality of mating lobe-shaped members circumferentially positioned about the centralizer body.

Still another feature of the invention is that a fluid-tight flow path is provided between the upper and lower subs of the centralizer by a hose positioned within the centralizer body and sealed with respect to the upper and lower subs.

An advantage of the centralizer according to the present invention is that the drill string may be reliably centered within a highly deviated portion of a well bore to reduce wear on the drill string caused by engagement with the sidewalls of the deviated borehole.

Still another advantage of the invention is that the centralizer body may flex with respect to an upper or lower drill pipe connected to the centralizer body, with flexing being permitted in any direction within a plane perpendicular to the axis of the respective upper or lower drill pipe.

Yet another advantage of the invention is that a pair of different diameter centralizer sleeves may be provided adjacent the drill bit for altering the drilling angle of the well bore by inclining the bit at a selected angle with respect to the well bore.

These and further objects, features, and advantages of the present invention will become apparent from the following detailed description, wherein referenced is made to the figures in the accompanying drawings.

DETAILED DESCRIPTION OF PREFERRED EMBODIMENTS

Figure 1:
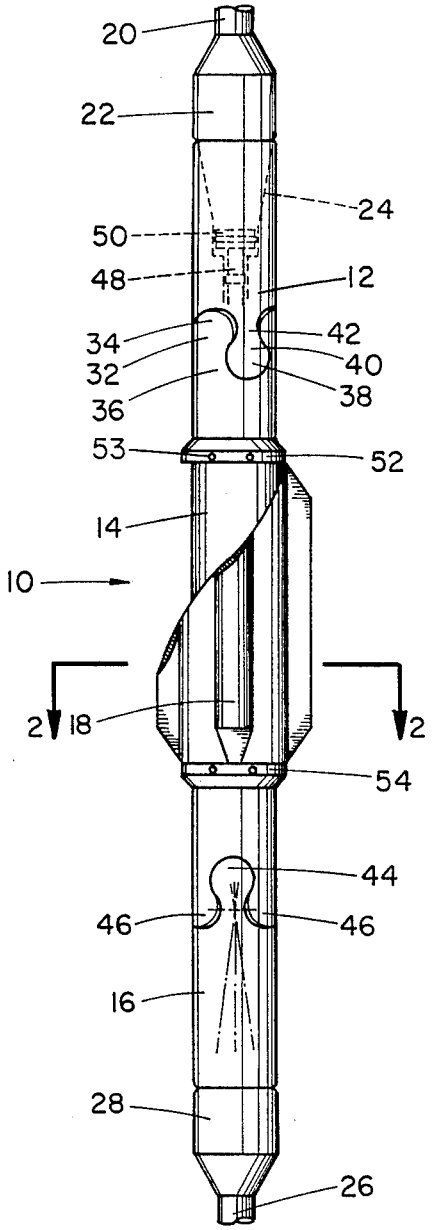
FIG. 1 is a pictorial view, partially in cross-section, of a centralizer according to the present invention connected to an upper and a lower drill pipe.

FIG. 1 depicts a centralizer 10 according to the present invention, comprising an upper sub 12, a centralizer body 14, a lower sub 16, and a flexible centralizer sleeve 18 carried on the body 14. A centralizer sleeve 18 is typically fabricated from a flexible plastic or rubber-like material, and comprises a plurality of centralizer blades positioned circumferentially around the body 14 and extend radially outwardly for engaging sidewalls of the formation. As explained hereafter, the centralizer sleeve is of the type conventionally used in downhole centralizers and stabilizers, and may rotate as a unit with respect to the body 14.

The centralizer 10 is conventionally positioned in a well bore along a string of drill pipe having a rotatable drill bit at the end of the drill string for drilling the borehole. Accordingly, centralizer 10 may be connected to an upper drill pipe joint 20 having a lower upset end 22 for threaded engagement with sub 12 by connecting threads 24. Similarly, a lower drill pipe joint 26 having an upper upset end 28 is similarly threaded to the lower sub 16 as shown. A drill bit will thus be conventionally provided at the end of drill pipe joint 26, or at the end of another drill pipe joint or sub connected to joint 26 or to another centralizer body.

The upper sub 12, the centralizer body 14, and the lower sub 16 are each substantially sleeve-shaped metal members having substantially aligned through passageways and relatively thick sidewalls. Sub 12 is interconnected with centralizer body 14 by a plurality of upwardly directed lobe-like members 32 and a plurality of mating downwardly-directed lobe-shaped members 38. Each of the lobe members 32 is preferably formed as an integral part of the body 14, and includes a lower neck portion 36 having a reduced circumferential width and an upper portion 34 of an expanded circumferential width. Similarly, each of the downwardly-directed lobe members 38 is preferably integrally formed as part of the sub 12, and has a lower expanded circumferential width portion 40 and a reduced circumferential neck portion 42. The sidewalls of the lobe members 32 and 38 preferably maintain a continuous arcuate configuration, with limited "play" between the sidewall surfaces permitting flexing of the centralizer body 14 in any direction within a plane perpendicular to the central axis of the upper sub 12. The lower end of the centralizer body 14 and the lower sub 16 are similarly provided with lobe members 44 and 46 which may be structurally and functionally identical to the lobe members previously described.

FIG. 1 depicts that the lobe-shaped connectors on the centralizer body 14 and the sub 16 permit the sub 16 and thus the lower drill pipe 26 fixedly interconnected therewith to move a selected amount, e.g. 4°, in any direction with respect to the centerline of the centralizer body 14. It should be appreciated that the lobe connections 32 and 38 between the upper sub 12 and the centralizer body 14 will permit the centralizer body to "bend" with respect to a centerline of the sub 12 (which is coaxial with the centerline of the drill string above the sub 12), and similarly the connections 44 and 46 between the centralizer body 14 and the sub 16 permit the centerline of the sub 16 and the drill pipe section below the centralizer to bend with respect to the centralizer body 14. These lobe connections thus allow the centralizer body to more easily pass through a highly curved borehole while reliably transmitting torque along the drill string through the centralizer and the bit, while the centralizer sleeve 18 maintains the drill string centered within the deviated portion of the borehole. Torque on the upper drill pipe 20 will accordingly be transmitted to the centralizer body 14 via the upper lobe connections 32 and 38, and will be transmitted from the centralizer body to the lower drill pipe sections and thence to the drill bit through the lower lobe connections 44 and 46. Although the deflection angle permitted between the centralizer body 14 and the respective upper or lower subs 12 and 16 may vary, it is a feature of the present invention that the lobe connections between the sub and the centralizer body permit an angular deviation of less than 4° per foot, and preferably between 1° and 3° per foot, between the centerlines of the centralizer body 14 and the respective sub. It should be understood that this deflection angle is substantially uniform about the circumference of the centralizer body, so that no attempt need be made to position the centralizer body 14 at any particular angle within the well bore to enable the drill string to "bend" within the deviated portion of the borehole.

Pressurized fluid for facilitating drilling by the bit is conventionally transmitted through the drill pipe and through the bore of the centralizer body 14 without substantial loss of fluid. It should be apparent from the foregoing description, however, that the sidewalls of the mating lobe connections do not sealingly engage each other. Accordingly, an elastomeric-material hose 48 is provided within the bore of the centralizer body 14, and extends from the upper sub 12 to the lower sub 16 for transmitting pressurized fluid through the centralizer. A hose fitting 50 is provided within each of the upper and lower subs, and maintains a fluid-tight seal between the hose 48 and each sub so that a significant amount of pressurized fluid is not lost between the lobe connections.

Figure 2:
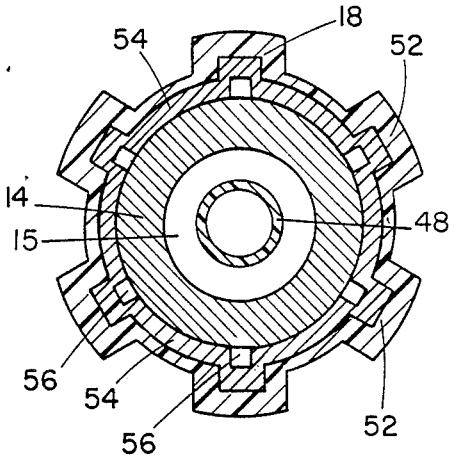
FIG. 2 is a cross-section of the centralizer along line 2—2 of FIG. 1.

FIG. 2 depicts the cross-sectional view of a portion of the centralizer 10 shown in FIG. 1. The sleeve-like metal centralizer body 14 preferably has a uniform outer diameter portion for carrying the centralizer sleeve 18. The centralizer body is shown with a bore 15 for housing the hose 48 which interconnects the upper and lower subs. The centralizer sleeve 18 comprises the plurality of circumferentially positioned centralizer blades 52, which are carried on and axially fixed with respect to the centralizer body 14 by an upper retaining ring 52 and a lower retaining ring 54. Each retaining ring may be provided with a plurality of set screws 53 for selectively fixing each retaining ring to the centralizer body 14. Respective upper and lower ends of the centralizer sleeve 18 may thus be fitted within an annulus between each retaining ring 52, 54 and the centralizer body 14, so that the upper and lower retaining rings axially secure the centralizer sleeve to the centralizer body while permitting the centralizer sleeve to freely rotate about the body.

Since the centralizer sleeve 18 may freely rotate about the body 14 as an assembly, the body 14 and the drill string on which it is positioned may rotate within the centralizer sleeve 18 while the centralizer sleeve is held in engagement with the sidewalls of a borehole by friction. A plurality of relatively thin arcuately-shaped fluid channels 56 are fitted between the uniform inner diameter portion of the sleeve body 54 and the blades 52, and extend axially along the length of the blades. The fluid channels 56 thus provide a fluid groove for lubricants, so that the centralizer sleeve 18 can move freely about the body 14. Those skilled in the art appreciate that the axial length of the uniform outer diameter portion of the body 14 radially inward of the elongate spacers 52 may also be polished to reduce friction between these spacers and the body 14, thereby facilitating easy rotation of the drill string about the centralizer sleeve 18 when in engagement with the sidewalls of the borehole. The centralizer sleeve 18 thus comprises a ring shaped solid steel body 54 and a high strength rubber coating 53 exterior thereof.

Figure 3:
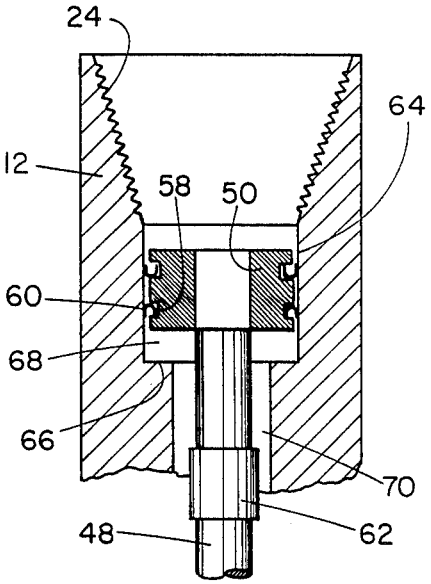
FIG. 3 is an enlarged cross-sectional view of a portion of the centralizer shown in FIG. 1.

FIG. 3 depicts a portion of the upper sub 12 having a substantially cylindrical outer surface preferably approximating the diameter of the centralizer body 14. Upper sub 14 includes tapered API threads 24 for sealing engagement with a drill pipe, as previously explained. A substantially cylindrical-shaped cavity 68 is provided between the threads 24 and the connection lobes 38 for receiving upper hose fitting 50. As shown in FIG. 3, hose fitting 50 may comprise a substantially cylindrical-shaped body with a circumferential groove 58 for receiving a plurality of o-rings 60, so that o-rings 60 maintains sealing engagement between the body 50 and the cylindrical sidewalls 64 of the cavity 68. Axial movement of the hose fitting 50 in both directions within the upper sub 12 is thus permitted to accommodate various changes in the tensional and compressional forces on the drill string and centralizer, while still maintaining sealing engagement between the hose 48 and the upper sub 12. A conventional coupling 62 may be used to interconnect the metallic hose fitting 50 with the flexible hose 48, which extends downward to the lower sub 16 where a similar coupling connects the lower end of the hose to a similar lower hose fitting for sealing engagement with the lower sub 16. The upper sub 12 includes a planar stop surface 66 for limiting axial movement of the hose fitting 50 toward the centralizer sleeve 18, with cylindrical passageway 70 extending from cavity 68 to the axially aligned bore 15 of the centralizer body 14 to accommodate the hose 48. As suggested from the foregoing description, the upper and lower subs may be structurally identical, and are connected to the centralizer body 14 in a mirror image relationship.

Figure 4:
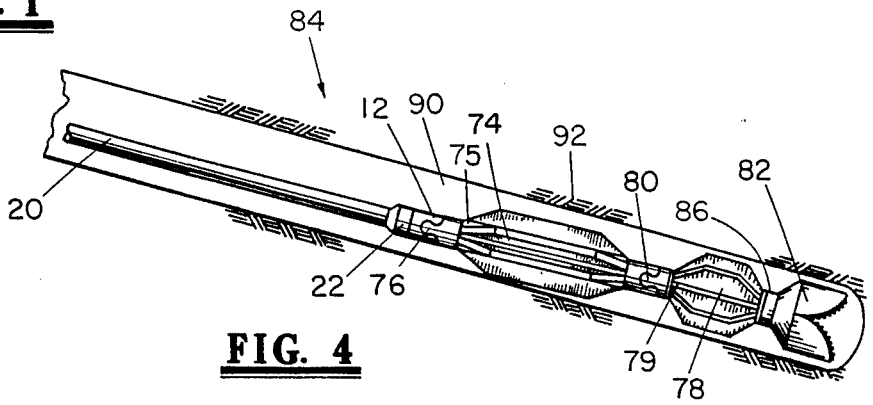
FIG. 4 illustrates another embodiment of a centralizer according to the present invention positioned within a substantially horizontal borehole, illustrating a comparatively small diameter centralizer sleeve adjacent a drill bit and a larger diameter centralizer sleeve therebetween.

FIG. 4 depicts a centralizer of the present invention performing a "stabilizer" and directional function of directing the bit to affect the drilling trajectory. The centralizer is shown in a deviated (almost horizontal) borehole 90 of a subterranean formation 92. Although a portion of a drill string could be within a deviated or even a horizontal portion of a borehole, it is conventional in the art to continue to use the terms "upper"

and "lower" to describe the location of components along the drill string, with the term "upper" meaning axially along the drill string and closer to the surface of the well, and the term "lower" meaning axially along the drill string and closer to the drill bit.

The centralizer 84 includes an upper sub 12 threadably connected to a lower end of a drill pipe joint 20, a relatively small diameter centralizer sleeve 74, and a relatively large diameter centralizer sleeve 78. Upper sub 12 is connected to upper centralizer body 75 by lobed connection members 76, as previously described. Upper centralizer body 75 thus may have an outer diameter not to exceed the diameter of the bit and approximating the diameter of the upper centralizer sleeve 74. The lower centralizer sleeve 78 is similarly carried on a larger diameter centralizer body or lower sub 79, and the upper centralizer body 75 and lower centralizer body 79 are structurally connected by lobe connections 80 as previously described. A relatively short sleeve-like member or sub 86 is threadably connected at its upper end to the lower centralizer body or sub 79, with a rotatable bit 82 being connected at its lower end for drilling the borehole. The axis of the drill bit 82 is thus coaxial with the axis of the body 79, which is intentionally inclined within the borehole due to the different diameters of the centralizer sleeves.

The larger diameter centralizer sleeve, which is also the axially shorter of the two centralizer sleeves shown in FIG. 4, is thus provided nearer to the bit than the other centralizer sleeve. This technique "balances" the system, so that the longitudinal center of the stabilizer coincides with the axial center point of the weight of the stabilizer between the drill bit and the lowest of the flexible joints (nearest to the bit). By providing the larger diameter and shorter centralizer very near the bit, passage of the drill string through a highly curved section of a well bore is also facilitated, since two "stiff" contact points are provided between the bit and the lowest centralizer.

An advantage of the centralizer 84 as depicted in FIG. 4 is that the centralizer may easily pass through a highly deviated portion of a borehole since the upper and lower lobe connections 76 and 80, respectively, are axially positioned closely adjacent one another. Also, by providing centralizer sleeves of different diameters, the trajectory of the drilled borehole may be influenced. Those skilled in the art appreciate that in a deviated or horizontal borehole, gravity forces tend to cause the drill bit 82 to drill the borehole in a more downwardly direction than may be intended. By providing the larger diameter centralizer sleeve 78 closely adjacent the drill bit 82 and the smaller diameter centralizer sleeve 74 farther away from the drill bit, the drill bit 82 is tilted slightly upward due to the pivot action between the gravity center point of each centralizer. This slight upward tilt of the drill bit may thus overcome the tendency of the drill bit to drill downward, so that the diameter of the centralizer sleeves 74 and 78, as well as the axial spacing of the centralizer sleeves with respect to the drill bit 82, may thus be adjusted to achieve the desired "tilt" for the drill bit and thus the desired trajectory for the drilled borehole.

Retaining members such as rings 52 and 54 previously described are commonly used to mount a stabilizer sleeve on a polished centralizer body. It should be apparent, however, that various other structural techniques may be used for rotatably mounting yet axially fixing a centralizer sleeve to a cylindrical-shaped centralizer body, and accordingly the retaining rings discussed herein are merely illustrative of a suitable mechanism for accomplishing that purpose. The centralizer sleeve comprising a plurality of centralizer blades are commercially available from various suppliers of oil field goods.

Various sealing mechanisms other than the type described above may be used to form a continuous fluid-tight seal between the flow conduit 48 and each of the upper and lower subs. Although it is preferable that this sealing mechanism be allowed to move axially in either direction to accommodate varying axially directed forces on the drill string, the sealing mechanism may be threadably secured to the respective upper or lower sub, and a face seal provided to form a fluid-tight connection therebetween. In this case, the flow conduit is preferably flexible to accommodate the varying axially directed forces acting on the drill string without resulting in fluid leakage past the gaps between the lobed connections.

In view of the foregoing description, those skilled in the art should appreciate that a plurality of centralizer bodies may be directly connected to each other to form a flexible portion of the drill string, as shown in FIG. 4, or that relatively short drill pipe sections may be spaced between an upper and a lower centralizer according to the present invention. The preferred location of the centralizers and the axial spacing between the centralizer bodies will thus depend upon the particular conditions of the drilled borehole or the borehole to be drilled, with the overall objective being to position one or more centralizers along the drill string to keep the drill string centered or approximately centered within the deviated portion of the borehole while also reliably transmitting torque to the drill bit. Since the drill string is centered within the borehole, substantial torque losses due to engagement of the rotating drill string with the deviated portion of a borehole are minimized, and the drill string life is enhanced because of reduced wear.

The geometry of the lobe connections as discussed above for interconnecting a sub with a centralizer body is preferred, although it should be understood that no particular geometry for these lobe connections is required according to the present invention. Each of the lobe connections preferably forms a partial sidewall of the drill string, and thus its arcuately-shaped radially inner and outer surfaces are equally spaced from a curved centerline plane uniformly spaced from the axis of its integral sub or centralizer body. Sharp angles in the circumferentially spaced edge surface of each lobe should be minimized or avoided to reliably transmit high torque loads while minimizing the likelihood of structural failure. The axial length of the mating lobes, as well as the circumferential width or angular spacing between the edge surfaces of both the neck portion of the lobe and the expanded portion of the lobe, will depend upon the size of the drill string, the wall thickness of the sub and the centralizer body at the location of the lobes, and the anticipated force to be transmitted from the surface to the drill bit. It is, however, a feature of the present invention that the entirety of each lobe connection be axially spaced closely adjacent the corresponding upper or lower end of the centralizer sleeve 18 to enable the centralizer to easily pass through a deviated wellbore. Preferably, each lobe connection is axially spaced less than about 5 times the uniform polished diameter of the centralizer body 14 from the corresponding end of the centralizer sleeve.

Although a centralizer according to the present invention preferably includes both an upper sub and a lower sub each connected to the centralizer body by respective lobe connections as described herein, it is also within the concept of the invention that only an upper or lower sub be provided, so that angular deviation between that sub and the centralizer body may occur, while the axially opposite end of the centralizer body is securely (no intended angular deviation) connected to its sub or drill pipe.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. An improved centralizer for positioning downhole within a drill pipe string passing through an angle building portion of a wellbore, the drill pipe string having a drill bit at its lower end for drilling the wellbore in response to rotation of the drill string while passing pressurized fluid through the drill string to the drill bit, the improved centralizer comprising:

a tubular-shaped centralizer body having a centralizer body central axis, a uniform outer diameter portion, and an inner bore;

a centralizer sleeve carried on and rotatable about the centralizer body for engaging sidewalls of the borehole;

the centralizer body having a first plurality of upwardly projecting lobe-shaped connectors at its upper end each axially spaced closely adjacent an upper end of the centralizer sleeve, and having a second plurality of downwardly projecting lobe-shaped connectors at its lower end each axially spaced closely adjacent a lower end of the centralizer sleeve;

an upper sub having an upper sub inner bore, an upper sub central axis, and a third plurality of downwardly projecting lobe-shaped connectors at a lower end for cooperation with the first lobe-shaped connectors to permit angular deviation of the centralizer body central axis with respect to the upper sub central axis while transmitting torque along the drill string to the drill bit;

a lower sub having a lower sub inner bore, a lower sub central axis, and a fourth plurality of upwardly projecting lobe-shaped connectors at an upper end for cooperation with the second lobe-shaped connectors to permit angular deviation of the centralizer body central axis with respect to the lower sub central axis while transmitting torque along the drill string to the drill bit;

a fluid conduit positioned within and extending axially through the inner bore of the centralizer body for transmitting pressurized fluid between the upper sub and the lower sub, the fluid conduit having an upper end within the upper sub inner bore and a lower end within the lower sub inner bore;

an upper sealing member positioned within the upper sub inner bore for sealing between the upper sub and the upper end of the fluid conduit; and a lower sealing member positioned within the lower sub inner bore for sealing between the lower sub and the lower end of the fluid conduit.

2. An improved centralizer as defined in claim 1, wherein the first lobe-shaped connectors are positioned on the centralizer body an axial distance of less than five times the diameter of the uniform outer diameter portion of the centralizer body from the upper end of the centralizer sleeve.

3. An improved centralizer as defined in claim 2, wherein the second lobe-shaped connectors are positioned on the centralizer body an axial distance of less than five times the diameter of the uniform outer diameter portion of the centralizer body from the lower end of the centralizer sleeve.

4. An improved centralizer as defined in claim 1, wherein the first and third lobe-shaped connectors permit angular deviation of the centralizer body of less than about 4° in any direction within a plane perpendicular to the upper sub central axis.

5. An improved centralizer as defined in claim 4, wherein the second and fourth lobe-shaped connectors permit angular deviation of the centralizer body of less than about 4° in any direction within a plane perpendicular to the lower sub central axis.

6. An improved centralizer as defined in claim 1, wherein the centralizer sleeve comprises a plurality of circumferentially-spaced radially outward projecting centralizer blades for engaging the sidewalls of the borehole.

7. An improved centralizer as defined in claim 1, further comprising:

the inner bore in the upper sub includes a cylindrical-shaped interior cavity portion; and the upper sealing member is axially movable within and sealingly engages the cylindrical-shaped interior cavity portion of the upper sub.

8. An improved centralizer as defined in claim 7, further comprising:

the inner bore in the lower sub includes a cylindrical-shaped interior cavity portion; and the lower sealing member is axially movable within and sealingly engages the cylindrical-shaped interior cavity portion of the lower sub.

9. An improved centralizer as defined in claim 1, wherein the outer configuration of each of the plurality of first, second, third, and fourth lobe-shaped connectors is a continuous arcuate configuration.

10. An improved centralizer for positioning downhole within a rotatable drill pipe string passing through a wellbore, the drill pipe string having an internal flow passageway for passing pressurized fluid through the drill pipe string, the improved centralizer comprising:

tubular-shaped centralizer body means having a centralizer body central axis, a uniform outer diameter portion, and an inner bore;

centralizer sleeve means carried on and rotatable about the centralizer body for engaging sidewalls of the wellbore;

the centralizer body means having a first plurality of lobe-shaped connectors at one end thereof each axially spaced closely adjacent a corresponding end of the centralizer sleeve means;

sub means having a sub central axis, a sub inner bore securing means at one end thereof for fixed engagement with a drill pipe, and a second plurality of lobe-shaped connectors at its other end for cooperation with the first lobe-shaped connectors to permit limited angular deviation between the centralizer body central axis and the sub central axis in any direction within a plane perpendicular to the sub central axis while transmitting torque along the drill string and through the centralizer body means;

flow conduit means positioned within and extending axially entirely through the inner bore in the centralizer body means for transmitting the pressurized fluid through the centralizer body means; and sealing means on said flow conduit means axially movable within the inner bore of the sub means for sealing between the sub means and the flow conduit means.

11. An improved centralizer as defined in claim 10, wherein the first lobe-shaped connectors are positioned on the centralizer body means an axial distance of less than five times the diameter of the uniform outer diameter portion of the centralizer body means from the corresponding end of the centralizer sleeve means.

12. An improved centralizer as defined in claim 10, wherein the centralizer sleeve means comprises a plurality of circumferentially-spaced radially outward projecting centralizer blades for engaging the sidewalls of the wellbore.

13. An improved centralizer assembly for positioning downhole along a drill string passing through a well bore, the drill string having an internal flow passageway for passing pressurized fluid through the drill string to a drill bit, the improved centralizer assembly comprising:

a first centralizer body having a first centralizer body central axis, a first uniform outer diameter portion, a first inner bore for transmitting the pressurized fluid through the drill string, and a first plurality of lobe-shaped connectors at one end thereof;

a second centralizer body having a second centralizer body central axis, a second uniform outer diameter portion, a second inner bore for transmitting the pressurized fluid through the drill string, and a second plurality of lobe-shaped connectors at one end thereof for cooperation with the first lobe-shaped connectors to premit limited angular deviation between the first centralizer body central axis and the second centralizer body central axis while transmitting torque along the drill string and through the centralizer assembly;

a first centralizer sleeve carried on and rotatable about the first centralizer body, the first centralizer sleeve including a first exterior surface for engaging sidewalls of the well bore, the first exterior surface having a first axial length and a first diameter;

a second centralizer sleeve carried on and rotatable about the second centralizer body, the second centralizer sleeve including a second exterior surface for engaging sidewalls of the well bore, the second exterior surface having a second axial length less than the first axial length of the first centralizer sleeve, and the second exterior surface having a second diameter greater than the first diameter of the first centralizer sleeve.

14. An improved centralizer assembly as defined in claim 13, wherein the second centralizer sleeve is positioned axially closer to the bit than the first centralizer sleeve.

15. An improved centralizer assembly as defined in claim 13, further comprising:

a flow conduit passing through the first inner bore in the first centralizer body and the second inner bore in the second centralizer body for transmitting the pressurized fluid through the centralizer assembly and to the bit.

16. An improved centralizer assembly as defined in claim 13, wherein the first lobe-shaped connectors are positioned on the first centralizer body an axial distance of less than 5 times the diameter the first uniform outer diameter portion of the first centralizer body from the corresponding end of the first centralizer sleeve, and the second lobe-shaped connectors are positioned on the second centralizer body an axial distance of less than 5 times the diameter of the uniform outer diameter portion of the second centralizer body from the corresponding end of the second centralizer sleeve.

* * * * *